United States Patent [19]

Stevenson

[11] 4,286,500

[45] Sep. 1, 1981

[54] ROTARY CONTROL VALVE FOR EXPANSION FLUID DRIVEN ENGINES

[75] Inventor: Robert L. Stevenson, Overland Park, Kans.

[73] Assignee: Havaco Incorporated, Overland Park, Kans.

[21] Appl. No.: 67,460

[22] Filed: Aug. 17, 1979

[51] Int. Cl.[3] ..... F01L 33/02

[52] U.S. Cl. ..... 91/180; 137/625.21

[58] Field of Search ..... 91/180; 137/625.21

[56] References Cited

U.S. PATENT DOCUMENTS

| | | | |
|---|---|---|---|
| 430,311 | 6/1890 | Eisenhuth | 91/180 |
| 630,767 | 8/1899 | Beadle | 91/180 |
| 878,578 | 2/1908 | Thompson . | |
| 1,038,970 | 9/1912 | Rydberg . | |
| 1,053,414 | 2/1913 | Ludwick . | |
| 2,070,880 | 2/1937 | Blum | 91/180 |
| 2,131,216 | 9/1938 | Brooke . | |
| 2,503,086 | 4/1950 | Albright . | |
| 3,068,012 | 12/1962 | Van Vleet . | |
| 3,608,308 | 9/1971 | Cary et al. . | |
| 3,893,295 | 7/1975 | Airas . | |
| 4,045,978 | 9/1977 | Abrahams et al. . | |

FOREIGN PATENT DOCUMENTS

| | | | |
|---|---|---|---|
| 2802504 | 8/1978 | Fed. Rep. of Germany | 91/180 |

*Primary Examiner*—Paul E. Maslousky

*Attorney, Agent, or Firm*—Fishburn, Gold and Litman

[57] ABSTRACT

A rotary control valve for an expansion fluid driven engine has a body with inlet and outlet ports and a distribution port communicating with an engine cylinder. A shaft in the body has first and second discs thereon and rotates in synchronization with reciprocation of the engine piston. The first disc has a pressure fluid passage therethrough and the second disc has an exhaust fluid passage therethrough. Sealing pistons in the body urge against the discs and have passages therethrough respectively connecting the pressure fluid passage with the inlet and distribution ports and the exhaust fluid passage with the distribution and outlet ports. The rotation of the discs alternately permits and stops flow of fluid to and from the cylinder.

8 Claims, 4 Drawing Figures

ROTARY CONTROL VALVE FOR EXPANSION FLUID DRIVEN ENGINES

This invention relates to expansion fluid driven engines and in particular to a control or distribution valve therefor.

Expansion fluid engines, such as open system steam driven engines, closed system Freon driven engines, and other types of engines which are driven by expanding gases or fluids are generally known in the art. Such engines require control valves to regulate the flow of working fluid through the engine and to selectively distribute pressurized fluid to the various expansion chambers of multi-cylinder engines. One example of such a control valve is shown in my copending application for U.S. patent, Ser. No. 923,184. The efficient and accurate control of the working fluid is essential to engine efficiency. As such control valves wear, the efficient and accurate control of the working fluid is often degraded and poor engine efficiency results.

The principal objects of the present invention are: to provide a rotary control valve for expansion fluid driven engines which efficiently regulates the flow of pressurized fluid through the engine cylinders; to provide such a valve which evenly distributes pressurized fluid to a plurality of cylinders in a multi-cylinder engine; to provide such a valve having a secure seal between passages for flow of pressurized intake fluid and unpressurized exhaust fluid; to provide such a valve having a minimal number of moving parts; to provide such a valve which resists fluid leakage and blow-by; to provide such a valve which is balanced for smooth operation; to provide such a valve adapted to deliver maximum power from an expansible fluid such as steam, Freon, or the like; to provide such a valve having a resilient member which urges sealing portions together for leak-free security; to provide such a valve which is particularly adapted for use in opposingly timed, multi-cylinder engines; to provide such a valve having rotatable members therein mounted to provide a slight wobbling rotation as required for effective sealing engagement with stationary members; and to provide such a valve which is durable in construction, lightweight and compact in structure, economical to manufacture, positive in operation, and particularly well adapted for its proposed use.

Other objects and advantages of this invention will become apparent from the following description taken in connection with the accompanying drawings wherein is set forth, by way of illustration and example, a certain embodiment of this invention.

Figure 1:
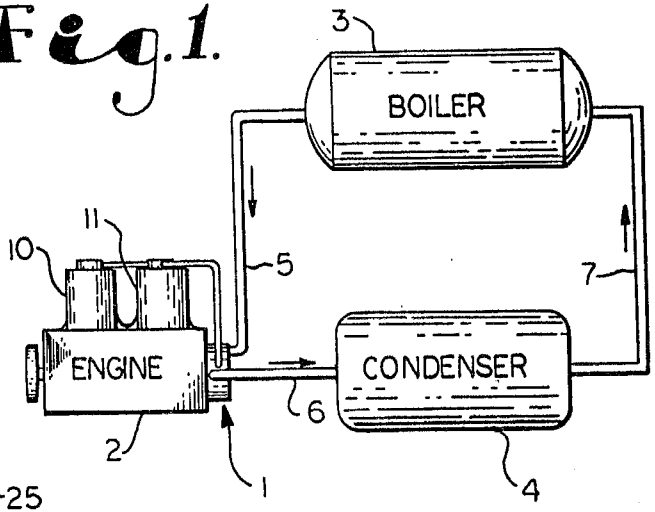
FIG. 1 is a diagrammatic illustration of an expansion fluid engine system having a control valve therefor embodying the present invention.

As required, a detailed embodiment of the present invention is disclosed herein, however, it is to be understood that the disclosed embodiment is merely exemplary of the invention which may be embodied in various forms. Therefore, specific functional and structural details as disclosed herein are not to be interpreted as limiting, but merely as a basis for the claims and as a representative basis for teaching one skilled in the art to variously employ the present invention in virtually any appropriately detailed structure.

Referring more in detail to the drawings:

The reference numeral 1 generally indicates a rotary control valve for an expansion fluid driven engine 2 having at least one cylinder with a piston therein. The expansion fluid engine may be a steam engine, a hot gas engine, or the like and in the illustrated example, derives motive power from a closed, system employing Freon gas and having a boiler 3 and a condenser 4. The Freon contained within the boiler 3 is heated by an outside source of energy, such as an electrical element, fossil fuel combustion, solar energy or the like, thereby pressurizing the Freon gas which is directed through a conduit 5 to each of the engine cylinders by the control valve 1. The spent or exhaust gases are directed through a conduit 6 from the valve 1 to the condenser 4 wherein the spent gases are condensed and returned to a liquid state. After condensing, the gas is reintroduced through conduit 7 into the boiler 3, thereby completing the closed system.

The exemplary engine 2 includes opposingly timed cylinders 10 and 11 respectively having pistons 12 and 13 reciprocably mounted therein. Each of the pistons includes a plurality of concentrically arranged, spaced apart pressure rings 14 and is connected to a throw arm 15 of a crank shaft 16 by an associated connecting rod 17. The crank shaft 16 is rotatably mounted in the engine block 18 by spaced apart main bearings 19, and includes a fly wheel 20 connected to the forward end thereof, and a rear shaft portion 21 connected with the rotary control valve 1. The exemplary cylinders 10 and 11 have a relatively short stroke wherein the stroke is equal to or less than 60% of the piston diameter. Each of these cylinders 10 and 11 includes a head member 22 with a fitting 23 disposed centrally therein to communicate the working fluid with the cylinder. The cylinders 10 and 11 are connected to the control valve 1 by respective separate conduit members 24 and 25.

A two cylinder expansion fluid driven engine is shown in the illustrated example, however, four cylinder, six cylinder or even greater numbers of cylinders may be employed in conjunction with the present invention. Where opposingly timed, multi-cylinder engines are used, one piston or set of pistons may be on a power stroke while the other piston or set thereof will be on an exhaust stroke. Accordingly, in the instance of opposingly timed engines, conduit members 24 and 25 may each split, or "Y" and route to like timed cylinders (not shown). Where multi-cylinder engines are employed which are not opposingly timed, separate conduits preferably extend to each cylinder and internal working members and passages of the valve 1 provide separate routing of working fluid to each of the cylinders as described below.

Figure 2:
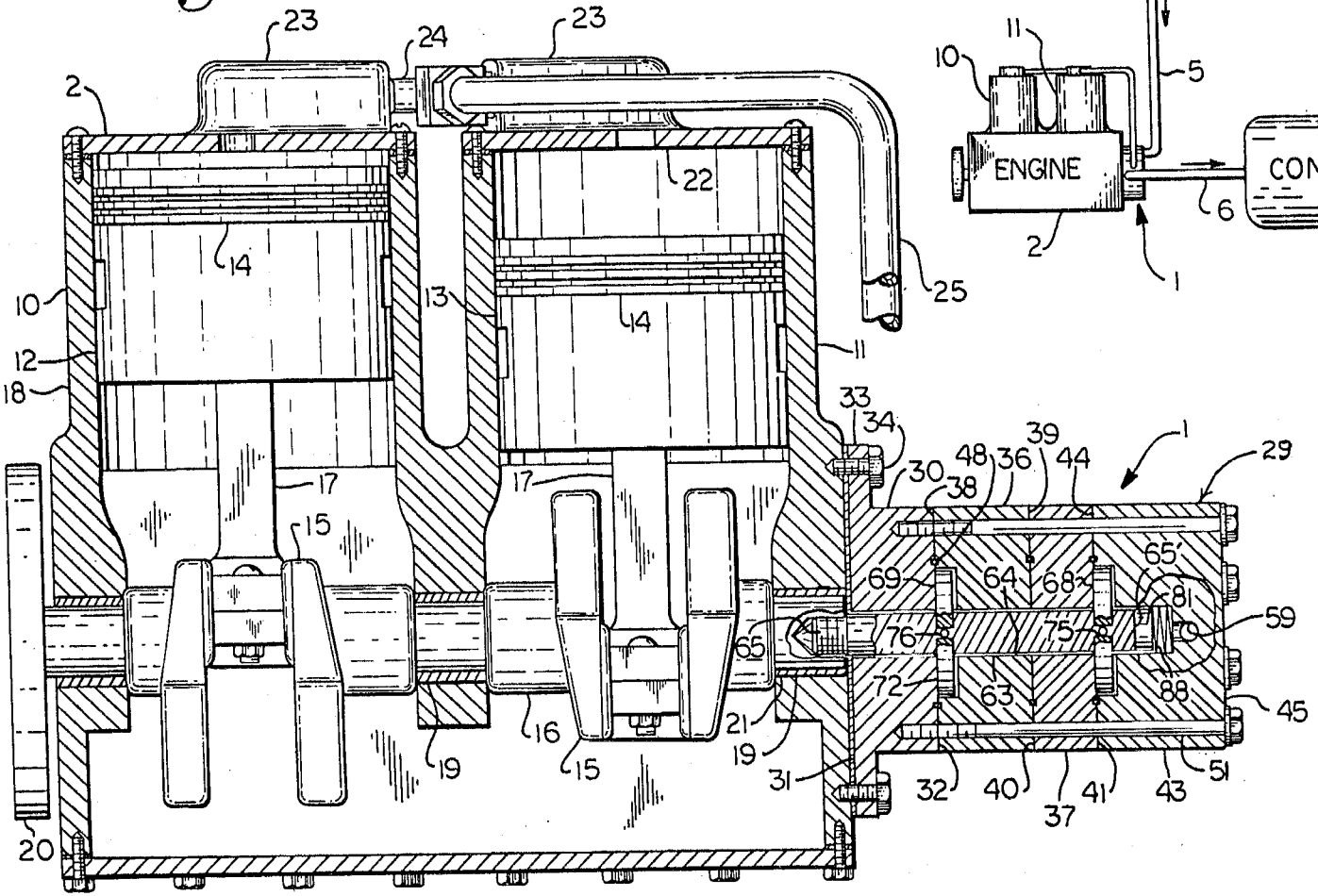
FIG. 2 is a vertical, longitudinal sectional view of the engine and the valve having portions thereof broken away to reveal details of internal construction.
Figure 4:
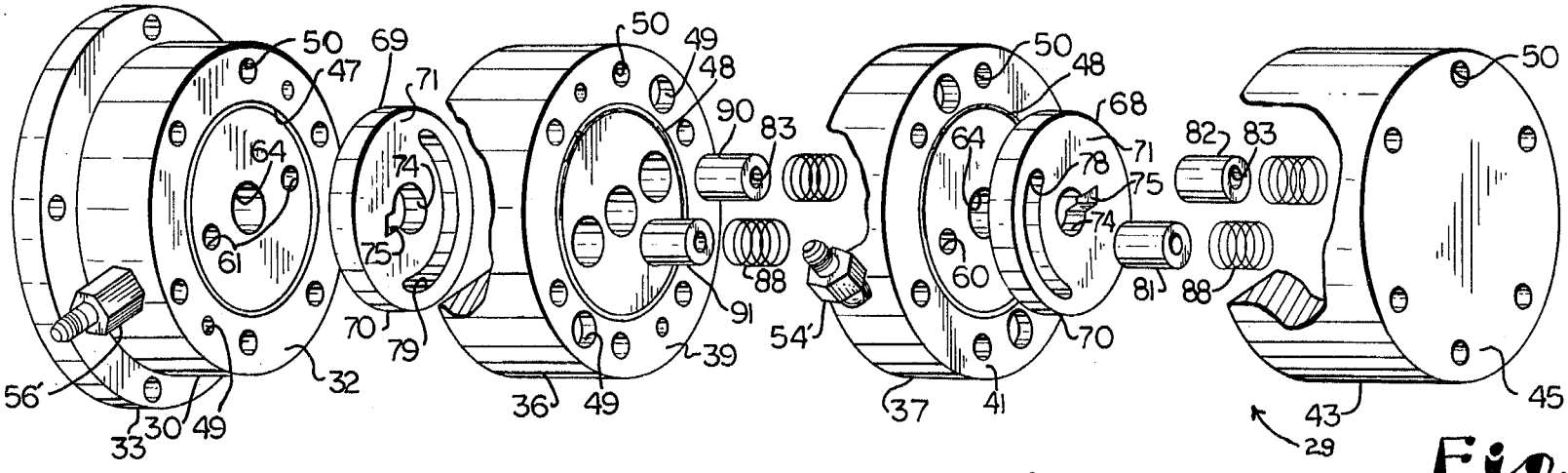
FIG. 4 is a disassembled, perspective view of the control valve.
Figure 3:
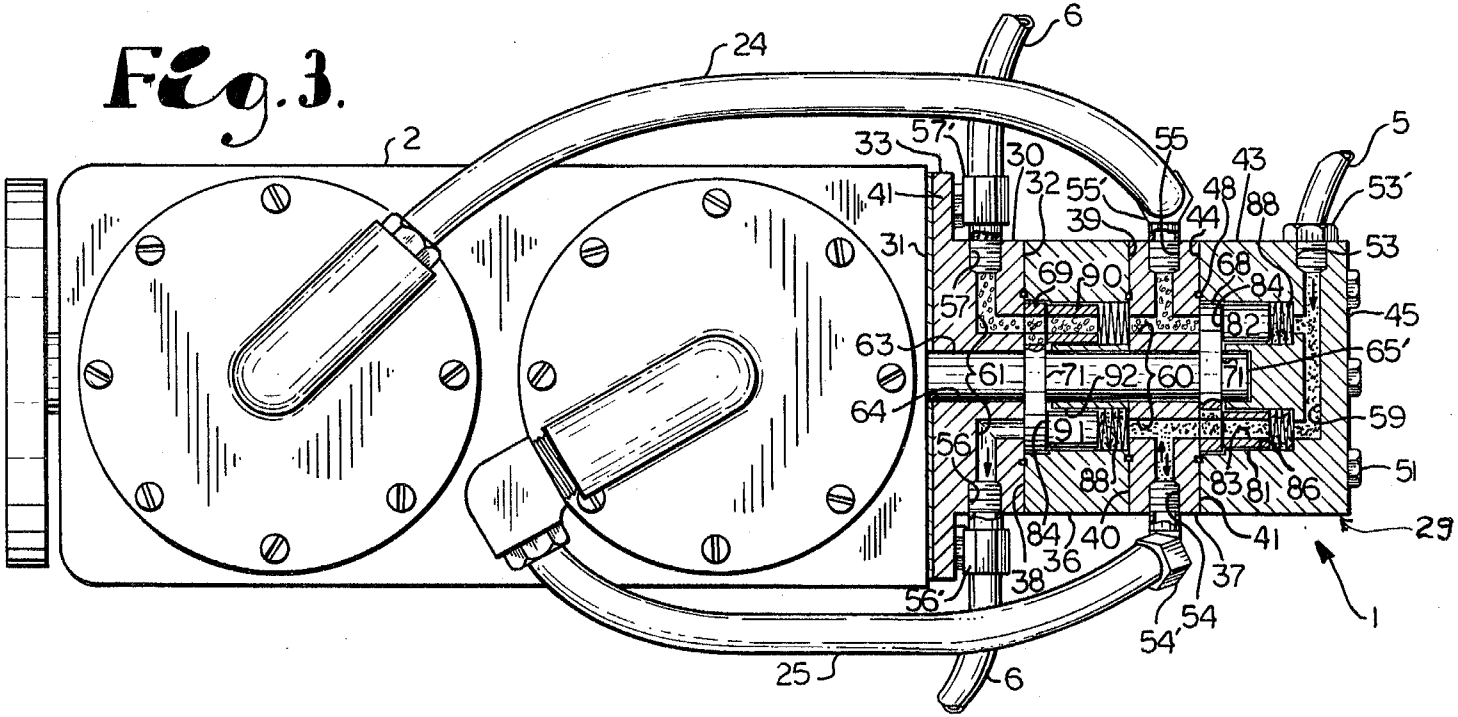
FIG. 3 is a top plan view of the engine and valve therefor with portions of the valve broken away to reveal internal details.

The rotary control valve 1 includes a body 29, FIGS. 2, 3 and 4, which, in the illustrated example, has a first end portion 30 with opposite, generally flat end surfaces 31 and 32 and an outwardly extending flange 33 at the end surface 31 for mounting, as by bolts 34, to the expansion fluid driven engine 2.

Intermediate sections of the exemplary valve body 1 include portions 36 and 37 having respective opposite end surfaces 38 and 39 and 40 and 41. A second end portion 43 is positioned in stacked relationship to the intermediate portions 36 and 37 and the first end member 30 to form the unitary valve body 29. The second end portion 43 has opposite end surfaces 44 and 45, the end surface 44 mating against the intermediate portion end surface 41 in sealing relationship.

To provide a seal between each of the valve body portions 30, 36, 37 and 43, the end surfaces 32, 39 and 41 each have an annular groove 47 coaxially positioned therein and with a ring seal member 48 engaged therein and sealably engaging respective end surfaces 38, 40 and 44 to provide a leak free valve body 29.

Bores 49 in the intermediate portion 46 and the first end portion 30 permit the same to be fastened together in stacked relationship and bores 50 in the body portions 30, 36, 37 and 43 receive elongate fasteners, such as bolts 51, which maintain the portions in engagement and stacked relationship.

The valve body 29 has a fluid inlet port 53 at the second end portion 43, spaced distribution ports 54 and 55 in the intermediate portion 37 and spaced fluid outlet ports 56 and 57 extend into the valve body first end portion 30. Suitable fittings 53', 54', 55', 56' and 57' are received in the appropriate ports 53, 54, 55, 56 and 57 for connection to conduits as described below. The valve body 29 contains suitable internal passages for communicating the fluid inlet port 53 with the distribution ports 54 and 55 and the distribution ports 54 and 55 with the fluid outlet ports 56 and 57. In the illustrated example, FIG. 3, the fluid inlet port 53 communicates with an internal passage 59 within the second end portion 43. The distribution ports 54 and 55 communicate with respective tee passages 60 within the intermediate portion 37. The fluid outlet ports 56 and 57 communicate with respective internal passages 61 within the first end portion 30 whereby the passages 59, 60 and 61 are aligned for registration with each other and means alternately stop and permit fluid flow during operation of the valve 1 as described below.

Means for causing rotation of certain internal parts, described below, within the valve 1 are provided and, in the illustrated example, a drive shaft 63 extends coaxially into the valve body 29 and is supported in aligned bores 64 for rotation therein. In the illustrated example, a drive shaft end portion 65 is threaded and secured within a socket in the rear shaft portion 21 of the engine crank shaft 16, thereby connecting the drive shaft 63 to the engine crank shaft 16. The exemplary shaft connection provides a means for rotating the valve drive shaft 63 and members mounted thereon, described below, in synchronization with reciprocation of the engine pistons 12 and 13. A remote shaft end portion 65' is contained within the end portion 43.

Rotor means are positioned within the valve body 29 and connected to the drive shaft 63 for rotation therewith. The rotor means provide valving to alternately open and close passages communicating the fluid inlet port 53 with the distribution ports 54 and 55 and the distribution ports with the outlet ports 56 and 57. In the illustrated example, the rotor means include first and second disc members 68 and 69, each disc member having a peripheral rim surface 70 and opposite face surfaces 71 and 72. The disc members 68 and 69 have aligned axial openings 74 through which the drive shaft 63 extends and slots or keys 75 for respective receipt of a pin 76 extending into the drive shaft 63. In the illustrated example, the pin 76 has a rounded periphery and the respective disc member 68 or 69 "floats" or has a wobbling movement on the drive shaft 63 as necessary for secure engagement with sealing portions as described below.

The first disc member 68 has a pressure fluid passage 78 extending therethrough and between the opposite face surfaces 71 and 72 and providing alternate communication of the inlet port 53 with the distribution port 54 and 55. The internal passage 59 leading from the inlet port 53 branches into passages respectively in registration with the tee passages 60 communicating with the distribution ports 54 and 55. As the first disc member 68 rotates on the drive shaft 63, the pressure fluid passage 78 rotates into and out of registration with the passages 59 and 60, thereby alternately closing and opening passages for routing pressurized fluid through the conduit 5 from the boiler 3 into conduits 24 and 25 leading to the cylinders 10 and 11. In the illustrated example, the pressure fluid passage is an elongate channel or slot which extends concentrically about the drive shaft openings 74 in an arcuate distance of approximately 96°. The elongate nature of the pressure fluid passage 78 provides for extended communication between the pressurized fluid and the expansion chamber of the engine 2 during the expansion stroke for increased power and further provides a means for starting the engine without an external starter.

Extended in opposition to the pressure fluid passage 78 is an exhaust fluid passage 79 which extends through the second disc member 69 and between the opposite face surfaces 71 and 72 and alternately communicates the distribution ports 54 and 55 with the fluid outlet ports 56 and 57 for routing spent or expanded gases from the cylinders 10 and 11 into the condenser 4. The exemplary exhaust fluid passage 79 also is an elongate channel or slot which extends concentrically about the drive shaft 63 and, in this instance, in an arcuate distance of approximately 151° for facilitating complete cylinder purging during the exhaust stroke. In the illustrated example, first and second disc members are situated on the drive shaft 63 so that the pressure and exhaust fluid passages 78 and 79 are spaced approximately 120° to 130° apart.

To provide a sliding seal between the passages within the valve body 29 and the passages 78 and 79 through the rotating disc members 68 and 69, piston members having passages therethrough are positioned within the body 29 in sealing engagement with one of the face surfaces of the disc members 68 and 69. One of the piston member passages provides communication between the fluid inlet port 53 and the distribution ports 54 and 55 with the first disc member 68 posed therebetween and rotatable to alternately close and open and route fluid to the cylinder. The other of the piston member passages provides communication between the distribution ports 54 and 55 and the outlet ports 56 and 57 with the second disc member 69 posed therebetween and rotatable to alternately close and open and route fluid from the cylinder.

In the illustrated example, the engine 2 is a multi-cylinder engine and ports and internal passages within the body 29 respectively route pressurized and exhaust fluids from each of the cylinders. Accordingly, the conduits 24 and 25 are respectively connected to the distribution ports 55 and 54. Each cylinder of the engine 2 corresponds to separate sets of internal passages 59, 60 and 61 within the valve body 29 for communicating fluid therewith and each of the sets of the passages 59, 60 and 61 also include separate piston members. In the illustrated example, a first set of piston members 81 and 82 is positioned within the body member 29 and suitably engages the face surface 71 of the first disc member 68. The piston members 81 and 82 may be of various shapes and in the illustrated example are relatively short, cylindrical members having passages 83 extending axially therethrough and a flat sealing face 84 for slidably contacting the face surface 71 of the respective disc member.

Sockets 86 are positioned within the second end portion 43 at junctures of the passages 59 with the end surface 44 and are spaced apart a distance from the bore 64 which corresponds to the distance between the axial opening 74 of the disc members 68 and 69 and the respective passage 68. The sockets 86 receive the piston members 81 and 82 and positions same so that the piston member passages 83 are aligned with the disc member passage 78 as the disc member 68 rotates to permit fluid communication.

Resilient means are positioned within the sockets 86 and urge the first piston members 81 and 82 into sealing engagement with the face surface 71 of the disc member 68 whereby piston members 81 and 82 provide a leak-free seal against the disc member 68. In the illustrated example, the resilient means include coil springs 88 positioned within the sockets 86 and urging the piston members 81 and 82 toward the disc member 68.

A second set of piston members 90 and 91 engages the face surface 71 of the second disc member 69 in a like manner. The second piston members 90 and 91 simularly have axial passages 83 therethrough and flat sealing faces 84 for sealing engagement with the disc member face surface 71. The piston members 90 and 91 are received in sockets 92 which, in the illustrated example, extend through the intermediate portion 36 in alignment with the passages 60 and 61. Resilient members such as coil springs 88 are received within the sockets 86 and extend between a rear face of the respective piston members 90 and 91 and the end surface 40 of the body intermediate portion 37. The piston members 90 and 91 are urged by the coil springs 88 into sliding engagement with the face surface 71 of the second disc member 69 with the respective passages 83 alternately communicating with the exhaust fluid passage 79 as the disc member 69 rotates to provide routing between the passages 60 and the passages 61 for directing spent or exhaust fluid from the cylinders 10 and 11 to the condenser 4.

In use, external energy is applied to the boiler 3 whereby the working fluid such as Freon, is pressurized and directed therefrom through the conduit 5 to the fluid inlet port 53 of the rotary control valve 1. The pressurized Freon is routed through the internal passage 59 and the passages 83 of the first set of piston members 81 and 82. The piston members 81 and 82 slidably engage the face surface 71 of the first disc member 68 in sealing relation. As the pressure fluid passage 78 rotates into registration with the respective passages 83 of the piston members 81 or 82, pressurized fluid flows therethrough and into one of the tee passages 60, the particular tee passage 60 depending upon the rotary position of the first disc member 68. In the illustrated example, FIG. 3, the pressure fluid passage 78 of the first disc member is in registration with the passage 83 of the piston member 81 whereby the pressurized fluid is directed through the distribution port 54 and through the conduit 25 to the cylinder 11.

In the exemplary arrangement, the pressure fluid passage 78 initiates communication with the respective piston member passage 83 to pass fluid to the distribution port 54 or 55 when the piston is approximately 12° before top dead center. The power or expansion stroke of the cylinders 10 and 11 continues until the trailing edge of the pressure fluid passage 78 completely rotates out of registration with the piston member passage 83.

Similarly, passage of pressurized fluid is effected through valve controlled communication between the fluid inlet port 53 and the distribution port 55, the pressurized fluid passing through the internal passage 59, the piston member 82 and the tee passage 60 prior to reaching the distribution port 55. As the first disc member 68 rotates, the pressure fluid passage 78 rotating therewith alternately provides communication between the internal passage 59 and the tee passages 60, thereby opening and closing fluid passages between the boiler and the engine cylinders.

Once in the respective cylinders 10 and 11, the pressurized gases are allowed to expand until the cylinder reaches a bottom dead center position, at which time the leading edge of the exhaust fluid passage 79 in the second disc member 69 communicates with the passage 83 of a respective piston member 90 or 91 and permits the spent gases to flow through the respective internal passages 61 and the outlet ports 56 or 57.

In the illustrated example, a separate piston member for intake and exhaust is provided for each of the cylinders 10 and 11 and, as illustrated in FIG. 3, piston members 82 and 90 have internal passages 83 providing routing to and from the cylinder 10. Similarly, pistons 81 and 91 have internal passages 83 providing routing to and from the cylinder 11. In each instance, the faces 84 of the piston members 81, 82, 90 and 91 provide sealing engagement for a leak-free rotary relationship with the disc members 68 and 69.

During the exhaust cycle or stroke, each of the cylinders 10 and 11 communicates with a respective fluid outlet port 56 and 57 until the trailing edge of the exhaust fluid passage 79 passes from registration, wherein the piston resumes an orientation in the nature of 12° before top dead center. The pressure fluid passage 78 recommunicates with the respective distribution port 54 or 55 and the cycle is repeated.

Simultaneously with pressurization and exhaust of the cylinder 10, the cylinder 11 is similarly pressurized and exhausted in opposed timing, whereby when the first cylinder 10 is beginning an expansion stroke, the second cylinder 11 is beginning an exhaust stroke and vice versa.

During the above described operation, the piston members 81, 82, 90 and 91 are urged into sealing relation with the respective disc members 68 and 69 whereby no gas leakage occurs therebetween. The flat sealing faces 84 of the piston members slidably engage the face surfaces 71 of the disc members in close tolerance thereto and the coil springs 88 apply pressure to move the sealing faces 84 into close, sliding engagement with the face surfaces 71 of the disc members. Furthering the maintenance of sliding, sealed engagement between the disc members 68 and 69 and the respective piston members 81, 82, 90 and 91 is the connection of the pin 76 with the drive shaft 63 and the cooperation of the pin 76 with the key shaped openings 75 of the respective disc members 68 and 69 to permit a wobbling or "floating" motion of the disc members 68 and 69 on the drive shaft 63 to accomodate any wear or possible misalignment therebetween. Moreover, the piston members 81, 82, 90 and 91 may move in respective sockets 86 and 92 to accomodate the wobbling or "floating" action.

It is to be understood that while one form of this invention has been illustrated and described, it is not to be limited to the specific form or arrangement of parts herein described and shown, except insofar as such limitations are included in the following claims.

What is claimed and desired to secure by Letters Patent is:

1. A rotary valve for an expansion fluid driven engine having a cylinder and a piston reciprocably mounted therein, said valve comprising:

(a) a body having a first end portion mounted to said engine, an intermediate portion and a second end portion;

(b) said body having a fluid inlet port at said second end portion, a distribution port at said intermediate portion for communicating with said cylinder, and a fluid outlet port at said first end portion;

(c) a drive shaft extending into said body and rotatably mounted therein;

(d) first and second disc members positioned within said body and mounted on said drive shaft for rotation therewith, said disc members each having a peripheral rim surface and opposite face surfaces;

(1) said first disc member having a pressure fluid passage extending therethrough and between said opposite face surface and alternately communicating said inlet port with said distribution port;

(2) said second disc member having an exhaust fluid passage extending therethrough and between said opposite face surfaces and alternately communicating said distribution port with said outlet port;

(e) means rotating said drive shaft and said first and second disc members thereon in synchronization with reciprocation of the engine piston;

(f) first and second piston members respectively having passages therethrough and sealing faces and positioned within said body against respective portions of said face surfaces of said first and second disc members; and (g) spring members in said body urging said piston members against said disc members with said sealing faces and said portions of said face surfaces in sealing engagement, the passage of the first piston member providing communication between said inlet port and said distribution port with portions of said first disc member posed therebetween and rotatable to alternately close and open and route fluid to said cylinder, the passage of the second piston member providing communication between said distribution port and said outlet port with portions of said second disc member posed therebetween and rotatable to alternately close and open and route fluid from said cylinder.

2. A rotary valve for an expansion fluid driven engine having cylinders and pistons reciprocably mounted therein and in opposed timing relationship, said valve comprising:

(a) a body mounted to said engine and having a fluid inlet port, distribution ports for each of said cylinders and fluid outlet ports for each of said cylinders;

(b) a drive shaft extending into said body and rotatably mounted therein;

(c) first and second disc members positioned within said body and mounted on said drive shaft for rotation therewith, said disc members each having a peripheral rim surface and opposite face surfaces;

(1) said first disc member having a pressure fluid passage extending therethrough and between said opposite face surfaces and alternately communicating said inlet port with said distribution ports;

(2) said second disc member having an exhaust fluid passage extending therethrough and between said opposite face surfaces and alternately communicating said distribution ports with said outlet ports;

(d) means rotating said drive shaft and said first and second disc members thereon in synchronization with reciprocation of the engine pistons;

(e) first and second sets of piston members respectively having passages therethrough and sealing faces positioned within said body against respective portions of said face surfaces of said first and second disc members; and (f) resilient means in said body urging said piston members against said disc members with said sealing faces and said portions of said face surfaces in sealing engagement, the passages of the first of said sets of piston members providing communication between said inlet port and said distribution ports with portions of said first disc member posed therebetween and rotatable to alternately close and open and route fluid to said cylinders, the passages of the second of said set of piston members providing communication between said distribution ports and said outlet ports with portions of said second disc members posed therebetween and rotatable to alternately close and open and route fluid from said cylinders.

3. A rotary control valve for an expansion fluid driven engine having a cylinder and a piston reciprocably mounted therein, said valve comprising:

(a) a body having a fluid inlet port, a distribution port for communicating with said cylinder and a fluid outlet port;

(b) a drive means extending into said body and rotatably mounted therein;

(c) first and second disc members positioned within said body and connected to said drive means for rotation therewith, said disc members each having a peripheral rim surface and opposite face surfaces;

(1) said first disc member having a pressure fluid passage extending therethrough and between said opposite face surfaces and alternately communicating said inlet port with said distribution port;

(2) said second disc member having an exhaust fluid passage extending therethrough and between said opposite face surfaces and alternately communicating said distribution port with said outlet port;

(d) means for rotating said drive means and said first and second disc members in synchronization with reciprocation of the engine piston;

(e) first and second piston members respectively having passages therethrough and sealing faces and positioned within said body against respective portions of said face surfaces of said first and second disc members; and (f) resilient means in said body urging said piston members against said disc members with said sealing faces and said portions of said face surfaces in sealing engagement, the passage of the first piston member providing communication between said inlet port and said distribution port with portions of said first disc member posed therebetween and rotatable to alternately close and open and route fluid to said cylinder, the passage of the second piston member providing communication between said distribution port and said outlet port with portions of said second disc member posed therebetween and rotatable to alternately close and open and route fluid from said cylinder.

4. The valve set forth in claim 3 wherein:

(a) said body has a first end portion for mounting to the engine, an intermediate portion and a second end portion; and (b) said fluid inlet port is in said second end portion, said distribution port is in said intermediate portion and said fluid outlet port is in said first end portion.

5. The valve set forth in claim 4 wherein:

(a) a plurality of seal members are positioned between said first end, intermediate and second end portions to prevent leakage of fluid between said portions.

6. The valve set forth in claim 3 wherein:

(a) said drive means is a drive shaft extending into said body and having said first and second disc members coaxially mounted thereon.

7. The valve set forth in claim 6 wherein:

(a) means mount said disc members to said drive shaft and permit wobbling movement of said disc members on said drive shaft to maintain sealed engagement of said portions of the face surfaces of respective said disc members with said piston members.

8. The valve set forth in claim 3 including:

(a) a conduit extending from said distribution port to said cylinder and providing passage for flow of pressurized fluid into said cylinder and flow of exhaust fluids out of said cylinder.

* * * * *